US006581340B2

(12) United States Patent
Orovay et al.

(10) Patent No.: US 6,581,340 B2
(45) Date of Patent: Jun. 24, 2003

(54) MODULAR ANTI-SEISMIC PROTECTION DEVICE TO BE USED IN BUILDINGS AND SIMILAR CONSTRUCTIONS

(75) Inventors: Vicente Signes Orovay, Valencia (ES); Javier Signes Orovay, Valencia (ES)

(73) Assignee: Innovacion Y Diseno Orovay, S.L., Valencia (ES)

( * ) Notice: Subject to any disclaimer, the term of this patent is extended or adjusted under 35 U.S.C. 154(b) by 0 days.

(21) Appl. No.: 09/883,610

(22) Filed: Jun. 19, 2001

(65) Prior Publication Data

US 2002/0035808 A1 Mar. 28, 2002

(30) Foreign Application Priority Data

Sep. 22, 2000 (ES) ..... 200002303

(51) Int. Cl.[7] ..... E04B 1/98

(52) U.S. Cl. ..... 52/167.1; 52/167.4; 52/167.7; 52/167.8

(58) Field of Search ..... 52/167.1, 167.4, 52/167.7, 167.8, DIG. 9; 181/286

(56) References Cited

U.S. PATENT DOCUMENTS

| | | | | |
|---|---|---|---|---|
| 4,555,433 A | | 11/1985 | Jablonka et al. | |
| 4,782,913 A | | 11/1988 | Hoffmann et al. | |
| 4,959,934 A | | 10/1990 | Yamada et al. | |
| 5,942,306 A | * | 8/1999 | Tom et al. | 428/76 |
| 6,249,925 B1 | * | 6/2001 | Ishida et al. | 52/167.7 |
| 6,385,918 B1 | * | 5/2002 | Robinson | 52/167.7 |

FOREIGN PATENT DOCUMENTS

| | | |
|---|---|---|
| DE | 34 46 831 C1 | 4/1986 |
| DE | 39 35 354 A1 | 4/1991 |
| EP | 0 481 146 A1 | 4/1992 |
| EP | 0 889 179 A1 | 1/1999 |
| FR | 2 391 324 | 12/1978 |
| FR | 2 510 645 | 2/1983 |
| GB | 2 120 167 A | 11/1983 |
| WO | WO 96/30602 | 10/1996 |
| WO | WO 98/57013 | 12/1998 |

* cited by examiner

*Primary Examiner*—Carl D. Friedman
*Assistant Examiner*—Nahid Amiri
(74) *Attorney, Agent, or Firm*—Brinks Hofer Gilson & Lione

(57) ABSTRACT

This invention is a modular anti-seismic protection device to be used in buildings and similar constructions. It discloses a modular base, which is to be laid on the ground below a building's foundation plate, to dampen, dissipate, and cancel out seismic waves.

21 Claims, 2 Drawing Sheets

MODULAR ANTI-SEISMIC PROTECTION DEVICE TO BE USED IN BUILDINGS AND SIMILAR CONSTRUCTIONS

PRIORITY REFERENCES

This application claims foreign priority benefits to Spanish Foreign Application Number 200002303 filed Sep. 22, 2000, and to PCT International Application Number PCT/ES01/00036 filed Feb. 8, 2001.

BACKGROUND

Several potential solutions have been devised to dampen or render harmless the effects of earthquakes. Most are based upon the use of elastic elements to absorb seismic waves.

For example, a German Patent (DE-3446831) describes an elastic body to be used as a support for constructions, in the form of a shaped strip with inner seatings that run lengthways in two rows and are staggered crosswise. The layout of the strip and the elastomeric material it is made of is designed to enable it to absorb considerable vertical stress. A similar structure is described in another German patent (DE-3935354).

Along the same lines, an English Patent (GB-2,120,167) describes a deformable structure consisting of two plates separated by an abscission layer containing material, such as foam, which becomes compressed under pressure. Alternatively, this structure can take the form of a honeycomb, subjecting the aforementioned plates to a process of elastic deformation bringing them closer together.

Likewise, a French Patent (2,510,645) describes a cell that acts against earthquakes. The cell is prismatic, eight-sided in shape, and is designed to fit in juxtaposition with other similar cells. It is designed to dampen momentary and vertical excessive stresses, such as those caused by an earthquake.

Another French Patent (2,391,324) also describes a system for protection against earthquakes. It consists of a steel plate that separates the construction itself from the foundation, in order to prevent cracks appearing in the foundation from spreading to the building.

A similar system is disclosed in PCT WO98/57013. The difference is that an isolating elastomeric support is used instead of a steel plate. This support is rigid and consists of inlaid pre-stressed fibres laid horizontally inside it.

Likewise, another PCT WO96/30602 describes a system for protecting buildings. In this system, buildings are founded on a flat structure suspended by hydraulic jacks to dampen seismic vibrations.

Similarly, a U.S. Pat. No. (4,959,934) describes an elastoplastic damper to be used in a structure, to absorb the vibrations that buildings are subjected to during seismic movements. The damper comprises a piece, which looks like a block or sheet of metal, with a number of separated openings that cover the whole surface to give it elastic deformability.

Another U.S. Pat. No. (4,555,433) describes an element for acoustic absorption. It comprises small plates and hollows that look like a small bowl, arranged in the form of a grid. If an element of this type is given the right structural rigidity, it can be used as a means for damping the vibrations caused by earthquakes, instead of being used as a means for damping acoustic vibrations.

Yet another U.S. Pat. No. (4,782,913) describes a construction element with acoustic properties. It is equipped with a core that either has a grille or is cellular. This device can absorb most acoustic waves, and if it is properly structured, is designed to be able to dampen the vibrations caused by earthquakes.

Likewise, a European Patent (EP 0889179) describes a construction bridge for absorbing shocks. The construction bridge consists of a series of horizontal parts arranged in series, with vertical parts supporting them, linked by means of absorbers that dampen the shock waves caused by an earthquake.

Another European Patent (EP 0481146 A1) describes a composite construction to cope with seismic movements. It is composed of a series of modules that are supported on the ground without foundations, and which support each other without any type of vertical connection. In such manner, each module can move in an unrestricted way crosswise with respect to the adjacent modules.

SUMMARY

The invention's disclosed modular anti-seismic protection device, to be used in buildings and similar constructions, utilizes a series of special features that provide advantages over the prior art.

In one aspect, a device providing an elastically deformable layer to protect against seismic waves, includes a layer of a plurality of modules, wherein each module comprises a first upper part attached to a second lower part. Further included is a circular flexible object disposed between the first upper part and the second lower part.

In another aspect, a device providing an elastically deformable layer to protect against seismic waves, includes a layer of a plurality of modules, wherein each module comprises a first upper part attached to a second lower part. Further included is a circular flexible object disposed within each module between the first upper part and the second lower part. Additionally, a block is disposed within each module. Each block is attached to both the first upper part and the second lower part in each module. Each module also includes granular material disposed within the module.

In yet another aspect, a method of constructing a modular anti-seismic protection device, to be used in buildings and similar constructions, to provide an elastically deformable layer to protect against seismic waves, is provided. A plurality of arranged modules, wherein each module comprises a first upper part and a second lower part, and a plurality of circular flexible objects are provided. At least one of said circular flexible objects is disposed between said first upper part and said second lower part in each of said modules. The first upper part is then attached to the second lower part in each of the modules.

The present invention, together with further objects and advantages, will be best understood by reference to the following detailed description taken in conjunction with the accompanying drawings.

DESCRIPTION OF THE DRAWINGS

To supplement the description that is being given and to make it easier to understand the characteristics of the invention, a set of drawings are enclosed. These drawings are illustrative in nature and in no way limiting, and show an example of one of the best ways to put this invention to practical use.

DESCRIPTION OF THE PREFERRED EMBODIMENTS

Figure 1:
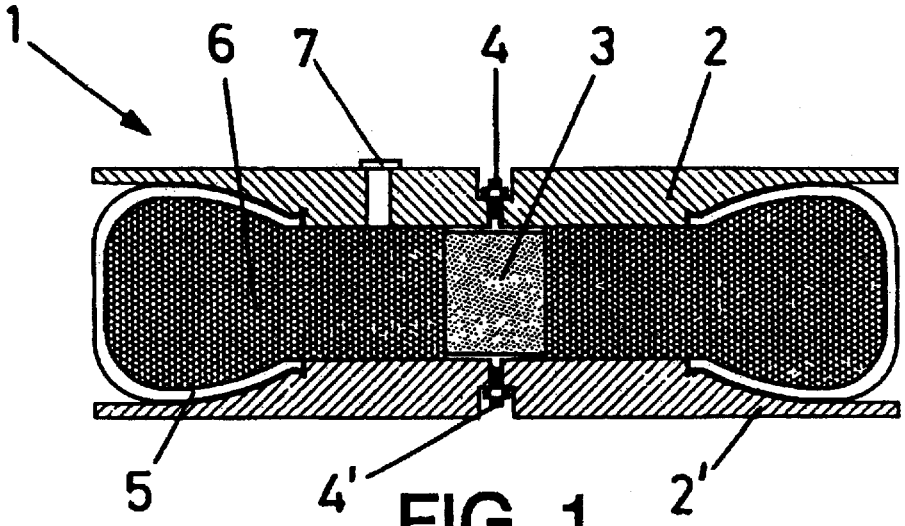
FIG. 1 shows one embodiment of a side elevation view and a diametrical cross-section of a module forming part of the modular anti-seismic protection device used in buildings and similar constructions. The embodiment shows the module at a time when there is no seismic wave activity.
Figure 2:
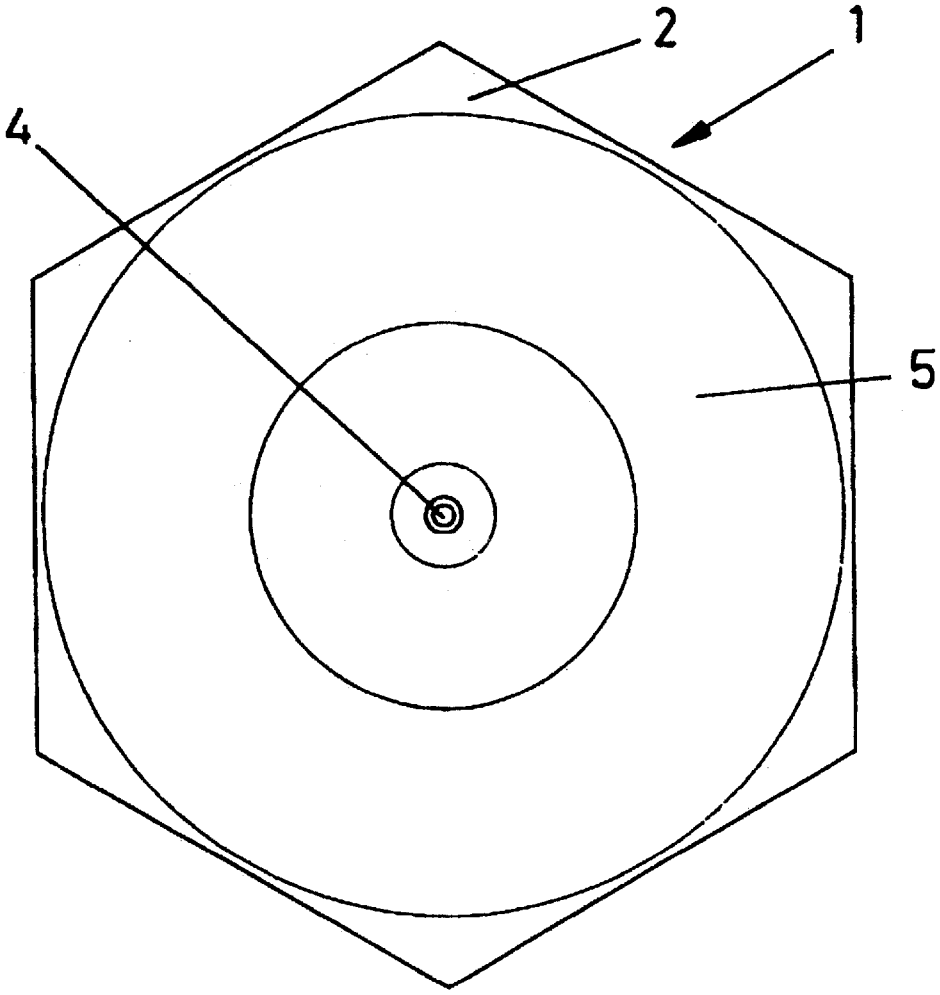
FIG. 2 shows a plan view of the object in FIG. 1.
Figure 3:
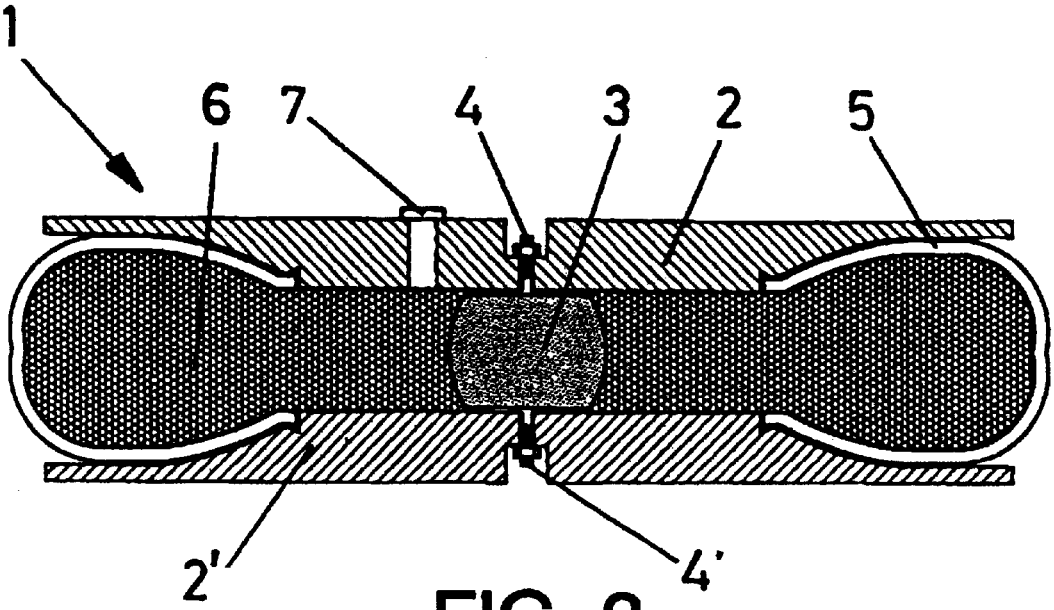
FIG. 3 shows a view of the object in FIGS. 1 and 2 when there is seismic wave activity.
Figure 4:
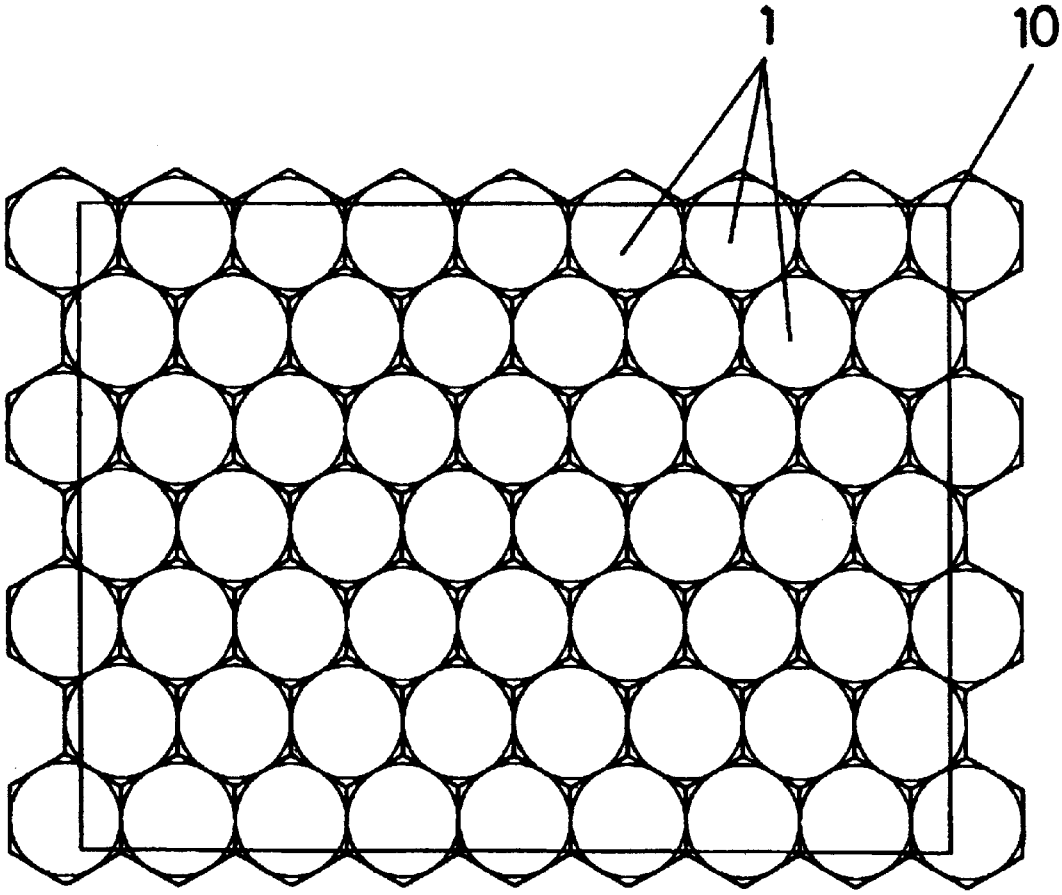
FIG. 4 shows a plan view of one embodiment of the modular anti-seismic device. As shown, a plurality of modules are arranged side by side at the base of a building before work begins on laying the concrete foundation.

As shown in FIG. 4, the modular anti-seismic protection device, to be used in buildings and similar constructions, is made up of a number of modules 1 which are positioned on the same plane and adjacent to each other with their sides in contact. As shown in FIGS. 1–3, each module 1 is structured with two parts of material 2 and 2', which may be plastic and identical, preferably joined to each other by means of a block 3. The block 3 is held in place by two retaining devices 4 and 4' disposed within the parts 2 and 2'. To hold the block 3 in place, two retaining nuts, which may be plastic, may be inserted into pockets within the parts 2 and 2.'

A circular flexible object 5, which may have a hollow interior and may be a car tire, is inserted between the parts 2 and 2', held in place by the block 3, before the parts are joined together. Granular material is inserted into the space left between the parts 2 and 2'. This forms a system 6 with a hydraulic effect. The granular material is inserted through a hole 7, made in the part 2, equipped with a cover seal for safety purposes.

As shown in FIG. 4, a number of modules 1 are placed on the same plane, lying on the ground where a building is to be constructed. The modules are laid at the bottom of the excavation works that have been dug for the foundations. This guarantees an even arrangement, which may be hexagonal, for the plastic parts 2 and 2'. The modular layout has two flat, parallel and largely unbroken surfaces, between which the circular flexible objects 5 are inserted at a tangent to each other. The circular flexible objects 5 may be arranged in the form of a quincunx, leaving small triangular voids with curved sides, in such a way that the slabs or foundation plates 10 can then be laid on this modular but continuous surface. The structure of the building is then constructed on those slabs or foundation plates 10.

In the event of seismic movement, the upward movement that the lower plastic plate 2' is subjected to, forces the modules 1 against the weight of the building, causing the granular material 6 contained within the circular objects 5 to move horizontally. This subjects the modules to radial deformation, as can be seen in an exaggerated way in FIG. 3. Because the circular flexible objects 5 are arranged tangentially, the deformation takes place towards the voids in the triangular layout, and the size of these spaces is sufficient to absorb the deformation, giving rise to an elastic effect. As soon as the impact of the seismic wave has been dampened, the modules 1 return to the original positions they were in before the earthquake occurred.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that the appended claims, including all equivalents thereof, are intended to define the scope of the invention.

What is claimed is:

1. A device comprising:

a layer of a plurality of modules arranged in the same plane tangentially between the ground and a foundation of buildings, wherein each module comprises a first upper part attached to a second lower part, and a circular flexible object disposed between said first upper part and said second lower part, wherein said layer is elastically deformable to protect against seismic waves.

2. The device of claim 1 wherein said circular flexible object is a tire.

3. The device of claim 1 wherein said first upper part and said second lower part are plastic.

4. The device of claim 1 further comprising a block, disposed between said first upper part and said second lower part, wherein said block is attached to both of said first upper part and said second lower part.

5. The device of claim 4 further comprising means for securing said block to both of said first upper part and to said second lower part.

6. The device of claim 5 wherein said means for securing is an interlocking bolt and nut.

7. The device of claim 1 wherein said plurality of modules are polygonal.

8. The device of claim 1 wherein said plurality of modules are arranged between the ground and the foundation of a building.

9. The device of claim 1 further comprising granular material disposed within said circular flexible object.

10. The device of claim 9 wherein said granular material is plastic.

11. A device comprising:

a layer of a plurality of modules arranged in the same plane tangentially between the ground and a foundation of buildings, wherein each module comprises a first upper part attached to a second lower part, and said layer is elastically deformable to protect against seismic waves;

a circular flexible object disposed within each module between said first upper part and said second lower part;

a block disposed within each module, wherein said block is attached to both of said first upper part and said second lower part in each module; and granular material disposed within each module.

12. The device of claim 11 wherein said circular flexible object is a tire.

13. A method of constructing a modular anti-seismic protection device, to be used in buildings, to provide an elastically deformable layer to protect against seismic waves, comprising:

providing a plurality of arranged modules arranged in the same plane tangentially between the ground and a foundation of buildings, wherein each module comprises a first upper part and a second lower part, and providing a plurality of circular flexible objects;

disposing at least one of said circular flexible objects between said first upper part and said second lower part in each of said modules; and attaching said first upper part to said second lower part in each of said modules.

attaching said first upper part to said second lower part in each of said modules.

14. The method of claim 13 further comprising disposing granular material within each module.

15. The method of claim 13 wherein said circular flexible objects are tires.

16. The method of claim 13 wherein said plurality of modules are polygonal.

17. A device comprising:

a layer of a plurality of modules, wherein each module comprises a first upper part attached to a second lower part, and a tire disposed between said first upper part and said second lower part, wherein said layer is elastically deformable to protect against seismic waves.

18. A device comprising:

a layer of a plurality of modules, wherein each module comprises a first upper part attached to a second lower part, and said layer is elastically deformable to protect against seismic waves;

a tire disposed within each module between said first upper part and said second lower part;

a block disposed within each module, wherein said block is attached to both of said first upper part and said second lower part in each module; and granular material disposed within each module.

19. A method of constructing a modular anti-seismic protection device, to be used in buildings, to provide an elastically deformable layer to protect against seismic waves, comprising:

providing a plurality of arranged modules, wherein each module comprises a first upper part and a second lower part, and providing a plurality of circular flexible objects;

disposing at least one of said circular flexible objects between said first upper part and said second lower part in each of said modules;

attaching said first upper part to said second lower part in each of said modules; and disposing granular material within each module.

20. A method of constructing a modular anti-seismic protection device, to be used in buildings, to provide an elastically deformable layer to protect against seismic waves, comprising:

providing a plurality of arranged modules, wherein each module comprises a first upper part and a second lower part, and providing a plurality of tires;

disposing at least one of said tires between said first upper part and said second lower part in each of said modules; and attaching said first upper part to said second lower part in each of said modules.

21. A method of constructing a modular anti-seismic protection device, to be used in buildings, to provide an elastically deformable layer to protect against seismic waves, comprising:

providing a plurality of arranged polygonal modules, wherein each polygonal module comprises a first upper part and a second lower part, and providing a plurality of circular flexible objects;

disposing at least one of said circular flexible objects between said first upper part and said second lower part in each of said polygonal modules; and attaching said first upper part to said second lower part in each of said polygonal modules.

* * * * *

UNITED STATES PATENT AND TRADEMARK OFFICE

CERTIFICATE OF CORRECTION

PATENT NO. : 6,581,340 B2
DATED : June 24, 2003
INVENTOR(S) : Vicente S. Orovay et al.

It is certified that error appears in the above-identified patent and that said Letters Patent is hereby corrected as shown below:

Column 4,
Lines 15 and 16, "attaching said first upper part to said second lower part in each of said modules." (the material is a duplicate of lines 13 and 14).

Signed and Sealed this

Thirteenth Day of July, 2004

JON W. DUDAS
*Acting Director of the United States Patent and Trademark Office*